United States Patent [19]

Fisher

[11] Patent Number: 4,476,662

[45] Date of Patent: Oct. 16, 1984

[54] JOIST GIRDER BUILDING CONSTRUCTION

[76] Inventor: James M. Fisher, 4401 N. Murray Ave., Shorewood, Wis. 53211

[21] Appl. No.: 315,849

[22] Filed: Oct. 28, 1981

[51] Int. Cl.[3] ..... E04B 5/43; E04B 7/00; E04B 1/68

[52] U.S. Cl. ..... 52/693; 52/263; 52/573; 52/690; 52/726; 403/170; 403/173; 403/217

[58] Field of Search ..... 52/263, 690, 692, 693, 52/726, 393, 656, 573; 403/217, 170, 173

[56] References Cited

U.S. PATENT DOCUMENTS 2,860,743 11/1958 Cliff ..... 52/693
2,902,951 9/1959 Maag ..... 52/692
3,131,791 5/1964 Davis, Jr. et al. ..... 52/721

FOREIGN PATENT DOCUMENTS 1418192 12/1975 United Kingdom ..... 52/263

*Primary Examiner*—Alfred C. Perham
*Attorney, Agent, or Firm*—Fuller, House & Hohenfeldt

[57] ABSTRACT

A joist girder construction includes connecting ties which connect adjacent ends of joist girders at a point where they are supported. The ties include a non-welded zone to afford plastic elongation of the tie. The ties create an axial connection force between the top chords to reduce the force a load causes within the joist girder to thus reduce the size of the upper and lower joist chords to minimize overall weight and expense.

11 Claims, 8 Drawing Figures

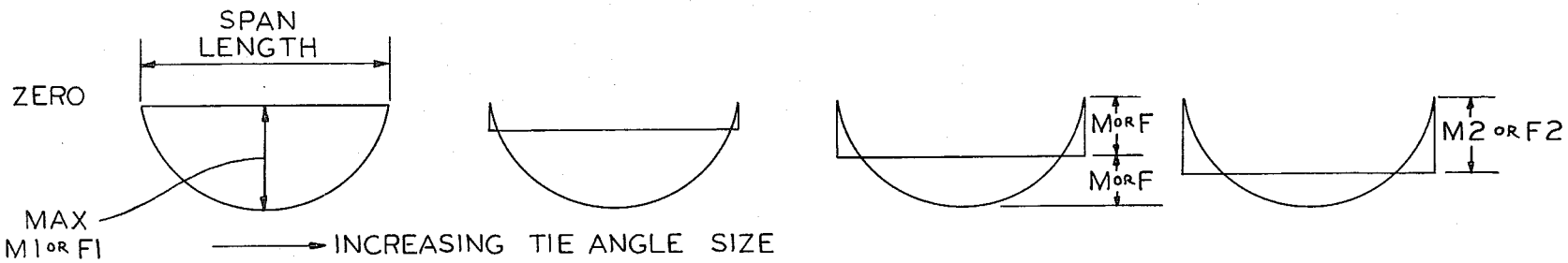
FIG.4D (PRIOR ART)
FIG.4C
FIG.4B
FIG.4A (PRIOR ART)
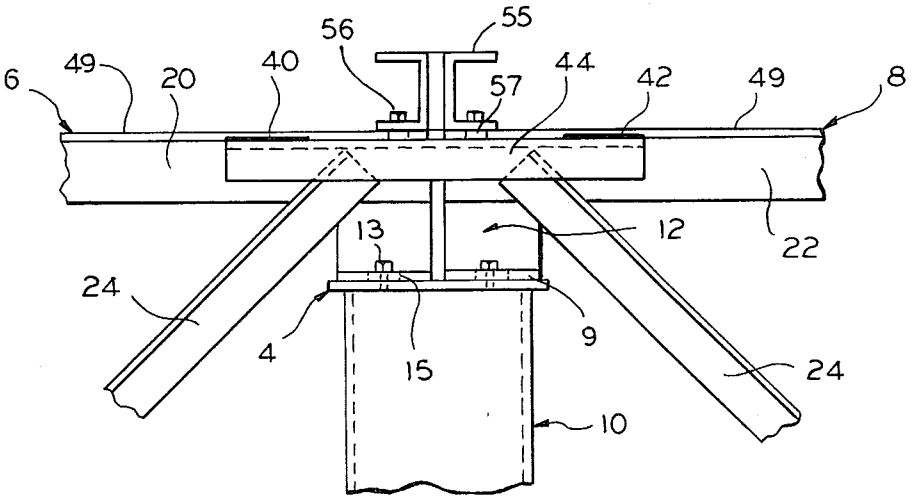
FIG.5

JOIST GIRDER BUILDING CONSTRUCTION

BACKGROUND OF THE INVENTION

In recent years joist girder floor and roof systems have become increasingly more popular as a structural system. Joist girders are a manufactured product and serve as a replacement for steel beams. In general, economic benefits will result in the substitution of joist girders for rolled beams in floor and roof systems. Conventional engineering practice is to design the joist girders as simply supported members, i.e. the ends of the joist girders are free to rotate. The design procedure follows design procedures established by the Steel Joist Institute in Standard Specifications for Joist girders adopted by Steel Joist Institute May 15, 1978, Steel Joist Institute, Richmond, Va. Steel joists which support flooring material or roof deck typically rest on the joist girders. The joist girders in turn are typically supported on steel or concrete columns. Typically, no attempt is made to achieve beam continuity by connecting the ends of the joist girders where they meet at a column.

The invention described herein relates to the use of end ties for connecting the adjoining ends of joist girders together, thereby providing continuity between joist girders at the supporting column. The purpose of using end ties is to create a horizontal end force through the ties to significantly reduce the axial forces in the upper and lower chords so that lighter weight chords can be employed to thus reduce the cost and weight of the joist girders required to accommodate the design load.

Continuity between adjoining structural elements and beams has been used for many years. For instance, steel beams are often positioned over the tops of supporting columns in a continuous manner, i.e. joined end-to-end. The use of continuous steel beams as opposed to simple span beams results in the use of smaller sized beams, thus reducing weight and cost. During the late 1950's plastic steel design concepts were developed in order to achieve an even greater economic benefit in continuous beam systems. This design concept is predicated on a material property characteristic of most structural steels. Specifically, the ability of steel to reach a given stress level (yield strength) and then to flow plastically without an increase or decrease in the stress level. The plastic design procedure makes use of this property by recognizing that once a beam reaches yield levels at highly stressed points the steel will "flow" and a redistribution of internal stresses will occur. This redistribution allows the designer to select beams of less weight, which again reduces cost. In addition to the required steel behavior, the steel beam must possess certain geometrical cross-sectional properties in order to permit the mentioned redistribution to occur without premature beam flange of beam web buckling. Should flange or web buckling occur prematurely, then the beam will not reach its full predicted load capacity and an inadequate factor of safety would exist. Most steel beams manufactured in the United States and foreign steel mills have the required geometrical cross-sectional properties to permit plastic design procedure.

Plastic design concepts permit the selection of a beam cross section to be based on an ultimate design moment of $(1/16)wL^2$; where w is the factored load per foot (safety factor times design load), and L is the beam span length. This moment is the optimum moment that can be used in design for a uniformly loaded structural member.

This optimum moment can also be achieved by using cantilever construction systems ("drop in systems"). These procedures have also been used for many years with steel beams and also in some cases with steel girders. Unlike plastic design procedures, this method does not rely upon yielding of the member or the reliance upon redistribution of stresses in the member in order to achieve the optimum moment condition of $(1/16)wL^2$, but rather by judiciously selecting the length of a cantilever from the support. Currently both the plastic design technique and the cantilever construction method are in common use for steel beams. The Fish U.S. Pat. No. 2,588,225 illustrates the cantilever construction.

Joist girders have not been designed using plastic design procedures because of very special design precautions which must be followed. In 1973, Croucher and I proposed a construction in which plastic design concepts could be used for steel trusses; Croucher and Fisher, AISC Engineering Journal, First Quarter, 1973, Vol. 10, No. 2, 1 pages 20–32. This concept required fixity of the ends of the trusses to supporting columns, with the yieldable mechanism being the end portions of the upper chord. This was made possible by redesign of the conventional truss diagonal layout. However, since the required geometrical layout and the connection requirements are "non-standard" for fabricated trusses and for steel joist girder fabricators, the procedure is not readily used. Cantilever construction techniques are occasionally used with joist girders and trusses; however, they have not met with wide acceptance due to connection costs and because they do not fit withing standard product lines for joist girder manufacturers.

By means of the present invention, standard joist girder geometrical layouts can be used, with reduced chord sizes as compared to simple spans or fully continuous spans. Load (stress) redistribution can be accomplished as in plastic design of beams without cost penalty for connections or non-standard layout. The tie connection angles or plates can be designed to yield at a predetermined moment so that a maximum moment of $(1/16)wL^2$ is created. The end result is a significant weight savings in the joist girders without the penalty of high cost field connections or changing existing standard geometrical layouts.

Tie plate connections that yield have been used by designers of multi-story steel frames to connect beams to columns. This concept of "semi-rigid connections" or "wind connections" has been used to provide a given moment capacity at a beam to column joint. The connections are designed to provide a given (determined) moment resistance from the beam to the column. The present invention is not used to transfer moment from a beam to column, but rather to achieve a load transfer across the top of the column, i.e. to transfer moment (force) from joist girder to joist girder.

Other prior art of interest is U.S. Pat. No. 3,793,790. In this patent the object is to reduce the size of the column by using a deflection pad to reduce the column moment caused by deflection of the lower chord of a joist girder under load.

SUMMARY OF THE INVENTION

The primary objective of this invention is to reduce the required size of joist girders to support the design loads. This is accomplished by connecting the adjacent ends of the top chords of two joist girders together by steel ties. The ties are of a predetermined size and can be in the form of plates or angles and are attached to the adjacent ends of the top chords of the joist girder by welding, bolting or other suitable means. The ties have non-welded or unattached zones intermediate the welded ends to obtain the benefit of plastic elongation of the ties. Plastic elongation will allow the ties to reach and maintain a constant stress level and minimize premature fracture of the tie connection. It is also necessary that the joist girder seat not be tightly connected to the column or any structure which would restrain the lateral movement of the top of the joist girder at the support location, which would minimize the benefits of plastic elongation.

In addition, to obtain the maximum benefit of the invention, adjacent ends of the bottom chords of the joist girders must be connected together so that forces may be transferred from one bottom chord to the other without significant elastic or inelastic shortening. The ties of the invention thus allow the joist girder to rotate or pivot about the bottom chord at the support location, restrained only by the ties connecting the top chords. Based on a given steel yield strength, the ties are mathematically sized to yield when a given load is placed on the joist girder. Having reached the yielded condition, a constant force is maintained in the connection tie. With the application of additional vertical loads, the joist girders will continue to deflect and carry the additional load as would a simple and conventionally supported joist girder.

Further objects, advantages and features of the invention will be apparent from the disclosure.

DESCRIPTION OF THE DRAWINGS

FIGS. 4A, B, C and D are force diagrams for different conditions between the upper chords of joist girders, with FIGS. 4A and 4D representing prior art conditions and FIGS. 4B and 4C illustrating connections within the purview of the invention.

FIG. 5 is a fragmentary enlarged view of the tie connection illustrated in FIGS. 1 and 2.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention which is defined by the claims.

Figure 1:
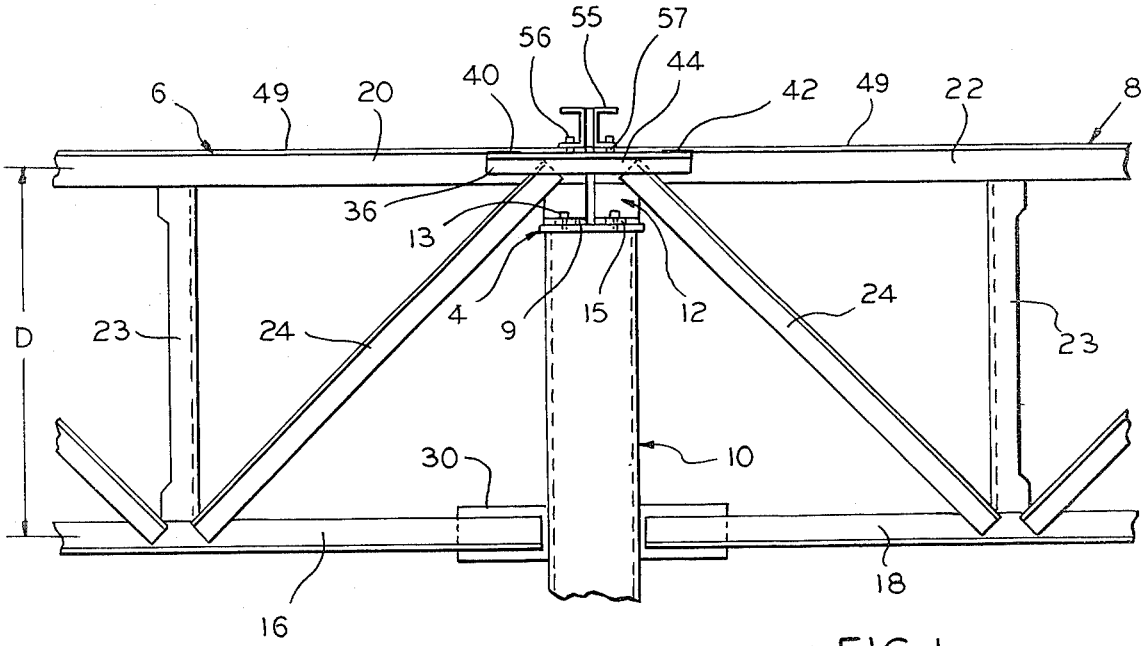
FIG. 1 is a fragmentary side elevational view of a joist girder and column connection with the top chord ties of the invention.

FIG. 1 shows two joist girders 6 and 8 and an intermediate supporting element of column 10 along a single framing line in a structure. Most structures which employ joist girders would include two or more of such frame lines. Joist girder seat 12 is attached by bolts 13 to the column cap 4. The bolts 13 secure the joist girders to the column against wind uplift and facilitate assembly. The bolts desirably extend through slots 15 in the flange 9 of the girder seat or the column cap 4 which enable plastic elongation of connecting ties as hereinafter described.

Also shown in FIGS. 1 and 5 is a steel joist seat 55 resting on top of the joist girder. The steel joist seat 55 is attached by bolts 56 to the joist girder top chord. The bolts desirably extend through slots 57 in the top chords 20, 22, which also enable plastic elongation of connecting ties as hereinafter described.

Each of the joist girders 6 and 8 include bottom chords 16, 18, top chords 20, 22, vertical members 23 and diagonal members 24. The bottom chords 16, 18 are bolted or welded to a plate or angle seat 30 which is fixed to the column 10. The plate 30 can extend through the column 10. Alternatively, the column 10 itself can provide the connection between the lower chords 16 to two adjacent joist girders.

Figure 2:
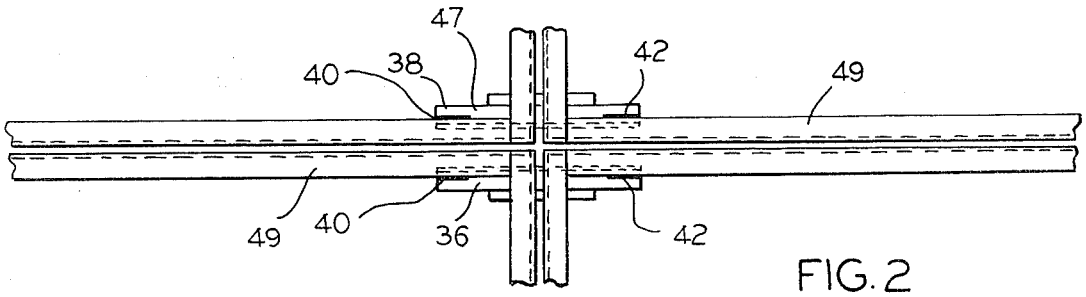
FIG. 2 is a plan view of the system shown in FIG. 1.

In accordance with the invention, tie means are employed to connect the adjacent ends of the top chords 20 and 22. In the disclosed construction, the means illustrated in FIGS. 1, 2 and 5 comprises short lengths of angle stock 36, 38. The angle ties 36, 38 are welded to opposite sides of the top chords 20, 22 along weld zones 40, 42 along the top legs 47 of the ties and the top edge 49 of the upper chords 20, 22. The weld zones 40, 42 are separated by a non-weld or plastic stretch zone 44 (FIG. 5). In FIGS. 1 and 2, the vertical legs of the angle ties 36, 38 are spaced from the vertical legs of the top chords to provide a space for the bolts 56. In FIG. 5, the vertical legs are spaced from the top chords to accommodate the bolts securing the steel joists and to provide clearance for wide diagonals 24. In FIG. 5, the mouth formed by the legs of the angle ties is facing the chords rather than facing outwardly as in FIG. 1.

Figure 3:
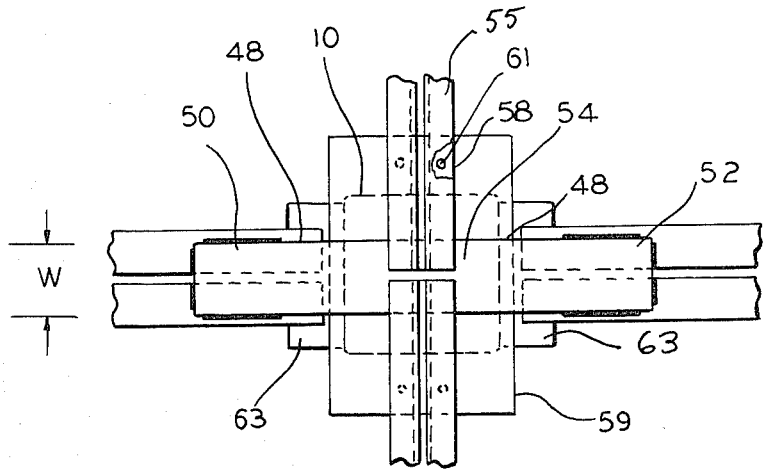
FIG. 3 is a plan view of a modified embodiment of a tie.

In the modified embodiment illustrated in FIG. 3, the tie means is in the form of a plate 48 with weld zones 50, 52 connecting the plate 48 to the top edges 49 of the upper chords 20 and a non-weld or plastic stretch zone 54. In the FIG. 3 embodiment, the upper chords are supported on seat angles 63 connected to the vertical sides of the column 10 rather than on the top of the column as illustrated in FIG. 1. The steel joist seat 58 is bolted at 61 or welded to the column cap 59. Thus slotted holes in the top chord of the joist girder are not required for plastic elongation to occur in the ties. Slots are required in the joist girder seat in FIGS. 1 and 5. The plastic stretch zone 54 is desirably equal to 1.2W. For the angle stock, W is equal to the sum of the adjoining leg lengths and for the plate 48, W equals the width of the plate 48. The 1.2W parameter is recommended in the design of semi-rigid connections for steel beams.

The function of the ties can be explained using the force diagrams 4A, 4B, 4C, 4D. The FIGS. 4A and 4D illustrate the forces in prior art joist girder assemblies. FIG. 4C is also illustrative of the truss design mentioned in Croucher and Fisher, AISC Engineering Journal, First Quarter, 1973, Vol. 10, No. 2, pages 29–32. FIGS. 4B and 4C illustrate joist girder assemblies using the tie means of the invention and a non-fixed connect-on of the joist girders to the supporting column, such as with bolts and slots as illustrated in the drawings. FIG. 4B has lighter weight ties than FIG. 4C and hence provides less horizontal force than generated in the 4C condition. However, the 4B condition is an improvement over the prior art and within the purview of the invention.

The chord force in the joist girder is equal to the moment divided by the centroidal distance d (the distance between the center of gravity of the upper and lower chords of the joist girder). A "simply" supported joist girder without any tie plates or end restraint which can rotate freely at its ends will have a force diagram as shown in FIG. 4A when subjected to a uniformly distributed load or gravity load. The maximum moment due to this loading will occur at mid-span and will equal $M_1=\frac{1}{8}wL^2$, where w is the load per foot of length and L is the span length. The chord force at the center of the joist girder will be $M_1$ divided by d. The size of the chord selected depends upon the chord force. A joist girder which is fully restrained at its ends, i.e. welded or bolted rigidly to a column or to an adjacent joist girder, will have a force diagram as shown in FIG. 4D. The maximum moment will be $M_2=(1/12)wL^2$. The size of the chords for this situation will be approximately fifty percent lighter than for the "simply" supported joist girder illustrated in FIG. 4A. This type of system is occasionally used; however, the cost of fully welded or bolted end connections may affect the cost benefits of the chord weight savings.

By properly sizing the tie angles or tie plates of this invention, the chord force can be varied between the simple span case FIG. 4A and the fully rigid case FIG. 4D. As material is added to the connecting ties, the shape of the force diagram will change progressively, as shown in FIGS. 4B and 4C. The optimum or balanced condition illustrated in 4C can be achieved when the end moment equals the interior moment $M=(1/16)wL^2$ or the force transferred through the ties equals the maximum chord force within the joist girders. This will result in minimum chord forces and thus a minimum weight design for the joist girder. In FIG. 4C, plastic elongation of the ties provides the desirable optimum moment of $M=(1/16)wL^2$. In a tie connection where there is no plastic stretch zone, such as zone 44, because of continuous welding of the ties to the top chords plastic flow cannot occur. Thus redistribution of forces cannot occur. Without redistribution, designs must be predicated on the larger force $F_2$ (FIG. 4D) occurring in the tie connection and in the joist girder chords. This requires more steel in the chords as compared to F (FIG. 4C). Hence the steel savings is not as great as with the 4C case.

In FIG. 4B, some horizontal forces are present as compared with the "simply" supported joist girder condition illustrated in FIG. 4A. However, in FIG. 4B the chords would have to be sized larger than with the FIG. 4C tie condition.

Selection of the proper size of connecting tie angles or plate to achieve optimum conditions is accomplished as follows:

(1) The optimum end moment is first determined:

$$M=(1/16)wL^2$$

(2) Based on a selected depth of joist girder, the force in the connecting ties is $F=M/d$.

(3) The area of connecting ties must equal the force divided by the steel yield strength.

(4) The connecting ties must then be attached to each joist girder top chord in a manner sufficient to transfer the force from the top chords through the connection ties and provide a plastic zone calculated to be equal to 1.2W.

With the appropriate chord ties, significant weight and cost savings result because optimum moments are used, thus reducing the size of the chords and hence the weight of and cost of the joist girders. In addition, standard joist girder geometrical layouts are used which is advantageous to the manufacturer and also the ties are less costly to use as compared to full continuity connections.

I claim:

1. In a joist girder construction including a support element for supporting adjacent ends of joist girders in which each joist girder has an upper chord, a lower chord and vertical and diagonal members interconnecting said upper and lower chords, the improvement to minimize the size of the upper and lower chords of the joist girder for a predetermined load comprising steel tie means connecting the adjacent ends of the upper chords of said joist girders, said tie means including a non-connected zone which affords plastic elongation and deformation of portions of said tie means and said tie means being sized to yield prior to said upper chord yielding and to transfer a sufficient horizontal force through said tie means to reduce the chord force said predetermined load causes within said joist girder, including fastening means for connecting said joist girders to said support element, said fastening means retaining said joist girders from separation from said supporting element but not interfering with plastic elongation of said tie means, said fastening means affording relative sliding movement between said support element and said upper chord.

2. The improvement of claim 1 wherein said tie means creates a connection force in a horizontal direction greater than 0 and less than the force which would be transferred by full fixity between said adjacent ends of said upper chords of said joist girders.

3. The improvement of claim 2 in which the connecting force created is greater than 0 and less than $(1/12)wL^2$ divided by d, where w is the uniform load between upper and lower chords and d is the centroidal distance between upper and lower chords.

4. The improvement of claim 1 or 2 in which the tie means comprises angle stock welded between the adjacent ends of said top chords, said tie means including non-welded center zones intermediate the weld zones to afford plastic deformation of the non-welded zones.

5. The improvement of claim 4 wherein the non-welded zones have a length of approximately 1.2W, where W is the sum of the lengths of the legs of said tie.

6. The improvement of claim 1 in which the tie means comprises a plate welded across the tops of said top chords and including a non-weld zone intermediate the welds of approximately 1.2W, where W is the width of the tie plate.

7. The improvement of claim 1 wherein said tie means reduces the chord forces in the joist girder to $\frac{1}{2}$ the chord forces in a "simply" supported beam supported on a supporting element.

8. The improvement of claim 1 wherein said tie means is sized so that it will yield so that a maximum moment of substantially $(wL^2/16)$ is achieved, where w is the uniform load per foot of length and L is the span length of said upper and lower chords.

9. The improvement of claim 1 wherein the chord forces within the joist girder between the upper and lower chords are substantially the same as the forces at the ends of the chords of the joist girder for the predetermined load.

10. The improvement of claim 1 wherein said fastening means includes horizontally open slots in the column cap or in adjacent ends of said joist girder seats and bolts extending through said slots and connected to said supporting element, said slots affording relative movement of said joist girders with respect to said supporting element.

11. In a joist girder construction including a support element for supporting adjacent ends of joist girders in which each joist girder has an upper chord, a lower chord and vertical and diagonal members interconnecting said upper and lower chords, the improvement to minimize the size of the upper and lower chords of the joist girder for a predetermined load comprising steel tie means connecting the adjacent ends of the upper chords of said joist girders, said tie means including a non-connected zone which affords plastic elongation and deformation of portions of said tie means and said tie means being sized with a smaller cross-sectional area than the cross-sectional area of the upper chord for the same material yield strength to yield prior to said upper chord yielding, including fastening means connected between the supporting element and the joist girder to afford relative sliding movement between said support element and said upper chord.

* * * * *